United States Patent [19]

Shinji et al.

[11] 4,312,399

[45] Jan. 26, 1982

[54] FLUX POWDER SUPPLYING APPARATUS FOR CONTINUOUS CASTING

[75] Inventors: Nishida Shinji, Okayama; Ohtsuka Takashi, Bizen; Satoh Mitsukuni, Okayama; Kashimoto Satoru, Wake, all of Japan

[73] Assignee: Shinagawa Refractories Co., Ltd., Tokyo, Japan

[21] Appl. No.: 129,383

[22] Filed: Oct. 31, 1979

[51] Int. Cl.[3] ..... B22D 11/10

[52] U.S. Cl. ..... 164/418; 164/437; 164/412

[58] Field of Search ..... 164/418, 55–58, 164/437, 412; 414/177, 179

[56] References Cited

U.S. PATENT DOCUMENTS

| | | | |
|---|---|---|---|
| 805,737 | 11/1905 | Lindquist | 414/177 X |
| 3,411,566 | 11/1968 | Astrov et al. | 164/418 |
| 3,900,065 | 8/1975 | Giunta et al. | 164/418 X |
| 3,970,135 | 7/1976 | Schmid et al. | 164/82 X |

FOREIGN PATENT DOCUMENTS

| | | |
|---|---|---|
| 51-48581 | 11/1976 | Japan . |
| 52-106410 | 8/1977 | Japan . |
| 52-39057 | 9/1977 | Japan . |

*Primary Examiner*—Robert L. Spruill
*Assistant Examiner*—J. Reed Batten, Jr.
*Attorney, Agent, or Firm*—Larson and Taylor

[57] ABSTRACT

This invention relates to an improvement of a flux powder supplying apparatus for continuous casting, and more particularly to the apparatus in which on a moving car 8 arranged near a mould 5 for casting there are placed a flux powder supplying apparatus 7 and a screw conveyor 11, at the end of the screw conveyor 11 there is connected a guide rod 16 mounted on the conveyor 11 to an arc-shaped guide 15, a crank mechanism 13 is provided connected to the conveyor 11, a nozzle opening 18 is idly fitted at the end portion of the screw conveyor 11 through the guide rod 16, the screw conveyor 11 and the crank mechanism 13 are respectively connected to motors 12, 14, and the nozzle opening 18 is reciprocally movable with optional control over the width direction of the mould 5. Accordingly, the apparatus of the invention is a flux powder supplying apparatus in which when pouring molten steel for continuous casting, it is possible to charge and sprinkle an optimum amount of flux powder to the surface of the molten steel continuously and uniformly.

1 Claim, 6 Drawing Figures

FLUX POWDER SUPPLYING APPARATUS FOR CONTINUOUS CASTING

TECHNICAL FIELD

This invention relates to an improvement in a flux powder supplying apparatus for continuous casting, and more particularly to a flux powder supplying apparatus in which it is possible to charge and sprinkle an optimum amount of flux powder onto the surface of molten steel continuously and uniformly when pouring for continuous casting.

BACKGROUND ART

Generally, when molten steel is poured from a tundish to a mould in continuous casting equipment, flux powder is sprinkled onto the surface of the molten steel in the mould, with the principal object of providing lubrication and heat retention of the molten steel.

Conventionally, flux powder is charged in such a way that the flux powder is placed above a mould, and the operator charges a suitable amount of flux powder while observing the surface of molten steel when pouring. Consequently, the working environment is adversely affected because of the high temperature and powdery dust generated from the molten steel, and the flux powder is supplied in an uneven distribution (i.e. uneven level).

There are presently utilized known apparatuses for supplying flux powder besides one (Japanese Utility Model Publication No. 48581/76) in which a screw conveyor is used, but these apparatuses have most important disadvantages in that a suitable amount of flux powder can hardly be sprinkled uniformly onto the surface of molten steel.

These days, there is used an apparatus (Japanese Utility Model Publication No. 39057/77) which uses a spring feeder, but it has less strength in view of its construction and thereby causes many troubles.

By the spring feeder is meant a feeder of known construction, in which a spring (coiled) is inserted, almost over the length, of a flexible hose provided beneath a hopper containing flux powder (material) and one end of said spring is directly connected to a motor. The flux powder proceeds by following the rotation of said spring which is rotated by means of the rotational, driving force of the motor, and then the flux powder is fed in said flexible hose to be supplied to a discharge port above a mould.

Further, Japanese Utility Model Publication No. 106410/77 proposes an automatic supply apparatus for flux powder, in which a supply pipe with an internally mounted screw is provided together on a stand and which is driven by means of a motor fixed at the rear of said supply pipe. Since the nozzle opening at the end of the screw makes a circular movement in this apparatus, however, flux powder cannot be sprinkled linearly and uniformly.

In addition, because of the rotary, circular movement affected by a gear it is impossible to change or regulate the moving range (stroke) of the nozzle opening, as necessary, to the width direction of the mould, and it is impossible to freely exchange the nozzle opening for sprinkling flux powder in proper amount and evenly in conformity with the size of the mould.

Thus, conventional apparatuses having spring feeder or screw feeder have fundamental, constructional faults or functional inconveniences and demerits so that at present operational requirements are not solved to satisfaction.

That is, the site of the pouring operation is always effected under the circumstances of high temperature and flying dust. Therefore, the constructional members become fragile and are unable to achieve the desired objects. Also, it has not been possible to sufficiently control the continuous, even feeding of flux powder in proper amount due to incomplete mechanism and operation.

DESCRIPTION OF THE INVENTION

According to the present invention, the disadvantages of the abovementioned conventional apparatuses are eliminated. The apparatus is simple but strong in construction and can perform accurate remote control. The present apparatus is bearing fruit in the pulverulent body field. It is a combination of constructional members as a main body, which scarcely causes trouble. It is of a strong construction in which a screw conveyor is provided swingably above the mould from the car, and to effect a linear, reciprocating movement of the nozzle opening at the end of said conveyor an arc-shaped guide and a crank mechanism are provided on the car off the mould. Also, the present apparatus can be easily, automatically operated.

That is, the invention relates to a flux powder supplying apparatus for continuous casting, in which a moving car is arranged near a mould for casting, a flux powder supplying apparatus and a screw conveyor are placed on said car, at the end of said screw conveyor there is connected a guide rod mounted on said conveyor to said arc-shaped guide, a crank mechanism is provided connected to said screw conveyor, a nozzle opening is idly fitted at the end portion of the screw conveyor through said guide rod, the screw conveyor and the crank mechanism are respectively connected to motors, and the nozzle opening is reciprocally movable with optional control over the width direction of the mould.

According to the present apparatus, the nozzle opening idly fitted at the end of the screw conveyor 11 can be controlled in a linear moving range over the width direction of the mould so that flux powder can be uniformly sprinkled in the thickness direction of the mould.

Further, the uniform sprinkling of the flux powder in a suitable amount is effected in such a manner that in the thickness direction of the mould, the shape and dimension of the nozzle opening idly fittable at the end of the screw conveyor, is formed in a mechanism exchangeable in response to the shape and kind of mould. Thus, nozzle openings of several shapes and dimensions may be prepared in advance thereby enabling freely to mount a nozzle opening with desired shape and dimension.

Furthermore, the principal mechanism for the reciprocating linear motion of said nozzle opening is provided on the car off the mould, and therefore it is shielded from high temperature, powdery dust, the spray of molten steel, etc.

Accordingly, the present apparatus is very effective from the standpoint of safety and sanitation, or strength and durability of the main portions of the apparatus, and further an accurate, quick remote control is possible by means of a separately mountable control board.

Thanks to a combination of said mechanism and members of the invention it is capable of sprinkling an optimum amount of flux powder continuously and at an even thickness to the surface of molten steel within the mould. Thus the invention provides a flux powder supplying apparatus for continuous casting, which is very useful in steel making or the like.

BEST MODE FOR CARRYING OUT THE INVENTION

The invention will now be described more in detail, by way of example only, with reference to the accompanying drawings.

Figure 1:
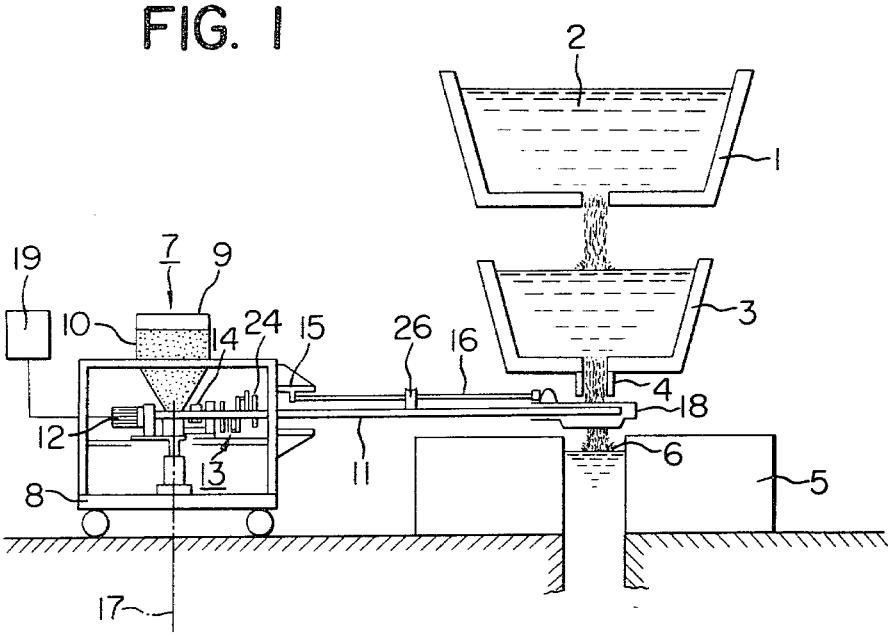
FIG. 1 is a vertical sectional view of one embodiment of the apparatus relating to the invention.
Figure 2:
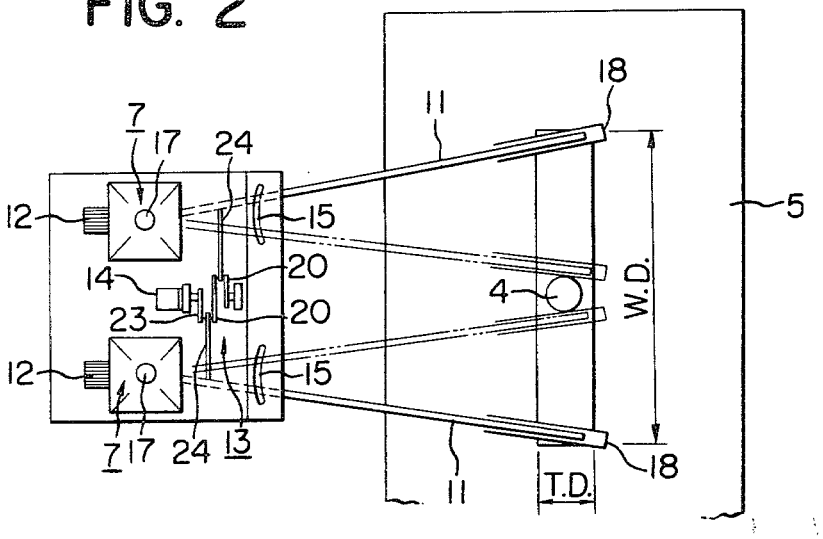
FIG. 2 is a plan view from the top of FIG. 1.

The entire apparatus of the invention is first described in its construction by referring to FIG. 1 and FIG. 2.

Molten steel 2 in a ladle 1 is received at a tundish 3, and the molten steel 2 is poured into a mould 5 through a tundish nozzle 4 mounted beneath the tundish 3. A flux powder 10 is uniformly supplied onto a surface 6 of the molten steel now poured, by means of a flux powder supplying apparatus 7.

The flux powder supplying apparatus 7 consists of a flux powder supplying hopper 9 placed on a moving car 8, a motor 12 for a screw beneath said hopper 9, and screw conveyors 11 connected directly to said motor 12 for screw (i.e. screw driving motor for screw conveyors), and flux powder 10 is fed within the screw conveyors 11, following the rotation of screw.

One end of a guide rod 16 bridged over a screw conveyor 11 is slidably fitted to a guide 15 consisting of an arc-like groove, said guide being provided on the car 8 at the rear side of said screw conveyor 11, and the other end of said guide rod 16 is mounted to the upper portion of a nozzle opening 18 idly fittable at the end of the screw conveyor 11.

A bracket member 26 is fixed at the center of the screw conveyor 11, the guide rod 16 is inserted slidably through said bracket member 26 through a bearing for example, and the nozzle opening 18 is supported in such a way that it can move reciprocatingly and linearly in the width direction of the mould.

The guide 15 and the guide rod 16 engage with each other through sliding members 21 such as ball bearing.

The guide 15 is one in which a metallic material is cut with an arc-shaped groove, the dimension and shape of said arc-shaped groove are designed in such a manner that it is possible for the nozzle opening 18 to carry out a reciprocal, linear movement, the guide rod 16 smoothly slides within said guide 15 by the sliding members 21, said sliding motion produces a swinging movement together with the screw conveyors 11, and it results in that the nozzle openings 18 idly fitted at the ends of the screw conveyors 11 make reciprocal, linear movements simultaneously. That is, it is possible to alter the swinging movements of the screw conveyors 11 themselves connected to a crank mechanism 13 provided on the car 8 by the guides 15, to those of said nozzle openings 18.

The swinging motion of the screw conveyor 11 is effected by means of the crank mechanism 13 provided on the car 8, and a motor 14 for crank is connected to said crank mechanism 13.

The motor 14 for the crank is to effect a swinging motion of the end of said screw conveyor 11, and it is a motor with nonstage transmission capable of normal and reverse rotations for driving the crank mechanism.

By controlling the rotating speed of said motor 14 for the crank, the rotating speed of the crank mechanism 13 can be optionally controlled, and as a result, it is possible to freely change the speed of the reciprocal, linear movement of said nozzle opening 18.

Figure 6:
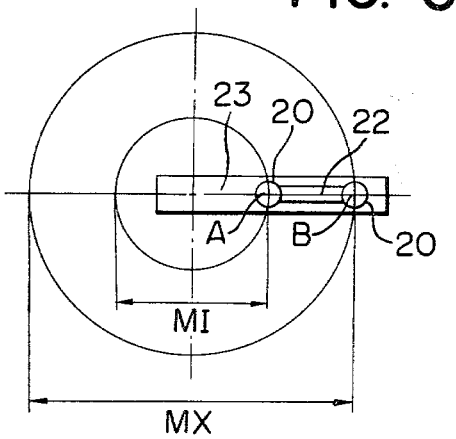
FIG. 6 is a view for explaining a stroke regulation based on the relationship between a crank shaft and crank bolts, viewed from an arrow a of FIG. 5.

Further, as shown in FIG. 2 and FIG. 6, it is possible to optionally change and control the stroke (the travelling distance of the nozzle opening 18) to the width direction of the mould, by setting crank bolts 20 at desired positions of a groove 22 bored at a crank shaft 23, in response to the size in the width direction of the mould, and fastening said crank bolts 20 to fix them to the crank shaft 23.

As is clear from the drawings, a fulcrum 17 of the swinging motion of the invention is set correspondingly to the center of the support stand of said flux powder supplying apparatus 7, at the rear portion of said screw conveyor 11.

A control board 19 is provided at a suitable position, said board being capable of controlling the motors 12 for screw and the motor 14 for crank and remotely controlling the present apparatus.

In the above embodiment description has been made with regard to a casting example of a cast piece having a great ratio between the width and the thickness such as ordinary slab, and therefore there are arranged in the drawings two sets of the respective flux powder supplying apparatuses 7 and screw conveyors 11. However, the arranging number thereof may not necessarily be limited to it.

Figure 3:
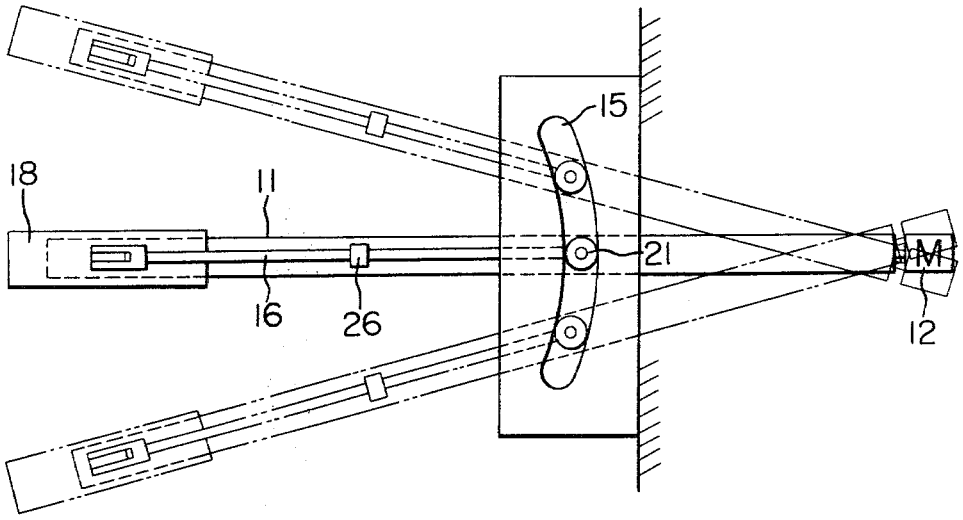
FIG. 3 is a partially enlarged plan view showing a combination of screw conveyors and a guide mechanism of the invention.
Figure 4:
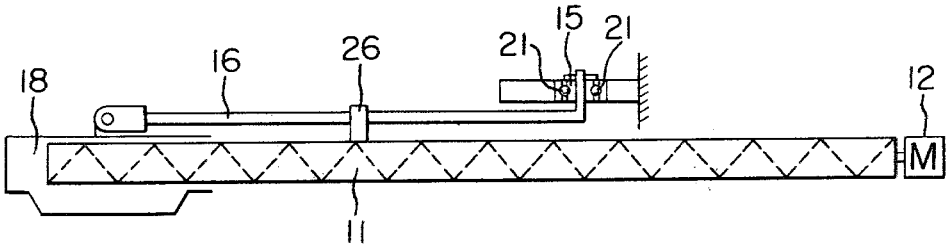
FIG. 4 is a side view of FIG. 3.

FIG. 3 and FIG. 4 show the mechanism of guide where a guide rod 16 is inserted slidably above the screw conveyor 11, through a bracket member 26, and the upper portion of said nozzling opening 18 and the guide rod 16 are fixed at the end of said screw conveyor 11 whereby the nozzle opening 18 is idly supported.

The other end of the guide rode 16 is inserted, to be slidable, into the guide 15 forming an arc-like groove, through the sliding members 21 such as ball bearings, as shown in FIG. 3 for example, and the most rear portion of the screw conveyor 11 is connected to the motor 12 for screw thereby to rotate the screw while feeding the flux powder charged from the flux powder supply hopper 9.

Figure 5:
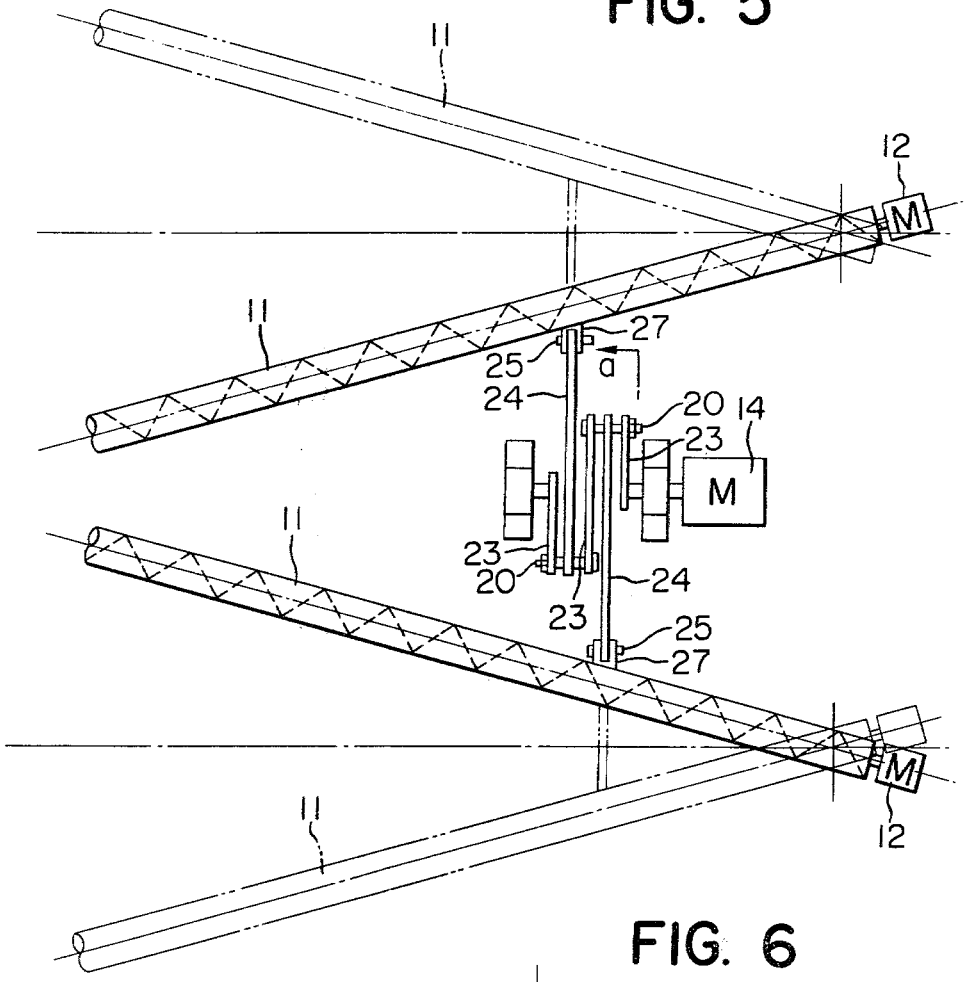
FIG. 5 is a partially enlarged plan view showing a combination of the screw conveyors and a crank mechanism of the invention.

FIG. 5 is an explanatory view of the construction of said crank mechanism 13 and said screw conveyors 11, and between two pairs of the screw conveyors 11 (a pair or more than three pairs thereof can be arranged according to the operational conditions at the scene of casting) there are provided the crank mechanism 13 and the motor 14 for crank.

Said crank mechanism 13 is of the following construction. That is, a crank rod 24 is connected through a pin 25 to a connecting member 27 fixed to the side face of the screw conveyor 11, and by means of crank bolt 20 the crank shafts 23 and the crank rod 24 are rotatably connected together.

FIG. 6 partially shows the crank shafts 23 only, viewed from an arrow a of FIG. 5, and it shows a mechanism capable of controlling, to optional and optimum set value, the stroke of said crank mechanism, in other words the stroke (the distance of reciprocating, linear motion) of the nozzle opening 18 idly fitted at the end of the screw conveyor 11.

In order to set said stroke at the minimum stroke (MI) it is all right to fix the crank bolt 20 at the position A as shown, in the groove 22 cut at the crank shaft 23, and if the setting to the maximum stroke (MX) is desired to the contrary, the crank bolt 20 may preferably be fixed at the position B, for example by means of a nut.

The ranges of the maximum stroke (MX) and the minimum stroke (MI) are determined by setting the optional stroke between point A and point B by predetermining the length of the groove 22.

According to the invention, there are prepared in advance, freely exchangeable, some kinds of the nozzle openings 18 for which shape and dimension are previously set, depending on the kind and size of the mould 5; by controlling the number of rotation of the motors 12 for screw and the motor 14 for crank it is possible to control the supplying amount of flux powder and the reciprocating, linear motion stroke of the nozzle opening in a wide range; and it is possible to sprinkle a suitable amount of flux powder to the surface of molten steel in the mould, uniformly, efficiently, accurately and as desired.

Below is mentioned an example of capacity numerical values of one embodiment (two units of screw conveyors) in the invention.

| | |
|---|---|
| Volume in the hopper: | 400 l |
| Supplying capacity: | 0.214–2.14 l/min. |
| Feeding distance: | 2.2 m |
| Screw diameter of the conveyor: | About 38 mm (1½") |
| Operating range of the nozzle: | 700 mm × 2 units = 1,400 mm |
| Operating speed of the nozzle: | 70–700 mm/min. |
| Capacity for the motors for screw: | 2 units of 0.2 KW |

-continued

| | |
|---|---|
| for crank: | A unit of 0.1 KW |

The major effects produced by the present invention are enumerated as follows:

(1) An optimum nozzle opening previously prepared is disengageably connected to the end of a screw conveyor so that the nozzle opening has great adaptability and inexchangeability to various kinds of moulds.

(2) It is possible to supply and sprinkle flux powder into the mould sufficiently and uniformly in a proper amount.

(3) There are no members causing fragility due to high temperature at all, and therefore the apparatus in its entirety is tough and can enjoy longevity, and accurate operation can be carried out whereby the apparatus has a great reliability.

(4) The supply amount and distribution range of flux powder can be regulated in a wide range, control can be made quickly and certainly, remote control can be effected smoothly, and the working places are hardly restricted because of the use of the car.

(5) The present apparatus is very effective from the standpoint of labor saving and environmental sanitation.

(6) Since it is possible to control the flux powder supply most suitably for continuous casting operation, defects in product ingots can be decreased.

What is claimed is:

1. A flux powder supplying apparatus for continuous casting comprising a moving car arranged near a casting mould, a screw conveyor on said car mounted through the lower portion of a flux powder supplying hopper, a screw driving motor for said screw conveyor, a crank mechanism for providing a swinging motion to said screw conveyor, an arc-shaped guide mounted on said car, a guide rod, a bracket member supporting said guide rod on said screw conveyor, one end of said guide rod being fitted through a sliding member to said arc-shaped guide, and the other end of said guide rod being connected to a nozzle opening idly fitted at the end of said screw conveyor whereby the nozzle opening is reciprocally and linearly movable with optional control over the width direction of the mould during said swinging motion of said screw conveyor.

* * * * *